US007028422B1

(12) United States Patent
Lewis

(10) Patent No.: US 7,028,422 B1
(45) Date of Patent: Apr. 18, 2006

(54) SHOE WITH CONCEALED COMPARTMENT FOR RETAINING ITEMS

(76) Inventor: Rosalie Lewis, 275 S. Beverly Dr., No. 210, Beverly Hills, CA (US) 90210

( * ) Notice: Subject to any disclaimer, the term of this patent is extended or adjusted under 35 U.S.C. 154(b) by 470 days.

(21) Appl. No.: 10/309,550

(22) Filed: Dec. 3, 2002

(51) Int. Cl.
*A43B 23/00* (2006.01)

(52) U.S. Cl. ..... 36/136

(58) Field of Classification Search ..... 36/136, 36/1, 165
See application file for complete search history.

(56) References Cited

U.S. PATENT DOCUMENTS 1,030,085 A * 6/1912 Hale ..... 36/11.5
1,736,827 A * 11/1929 Johnson ..... 36/165
1,907,995 A * 5/1933 Nickerson ..... 36/163
2,070,814 A * 2/1937 Stemmons ..... 36/165
2,478,411 A * 8/1949 Martin ..... 36/1
3,328,900 A * 7/1967 Weitzner ..... 36/1
5,220,735 A * 6/1993 Raoul-Duval ..... 36/8.3
6,000,147 A * 12/1999 Kellerman ..... 36/44

FOREIGN PATENT DOCUMENTS

DE 3824352 * 2/1990

* cited by examiner

*Primary Examiner*—Ted Kavanaugh
(74) *Attorney, Agent, or Firm*—Thomas I. Rozsa; Tony D. Chen

(57) ABSTRACT

A shoe having the unique feature of a concealed compartment within the shoe to enable valuables to be concealed in a safe and secure manner so that they are concealed while at the same time not interfering with the wearability of the shoe. The concealed compartment is either formed within a two-piece inner sole so that the compartment is formed within the lower portion of the inner sole and the upper portion of the inner sole is removably attached to the lower portion of the inner sole through fastener means so that when the fastener means are closed, the compartment is concealed and when the fastener means are opened, the upper portion of the inner sole can be moved away from the lower portion of the inner sole to expose the compartment. Alternatively, the compartment is formed into a separate compartment layer which is positioned above the outer sole and below the inner sole.

6 Claims, 4 Drawing Sheets

SHOE WITH CONCEALED COMPARTMENT FOR RETAINING ITEMS

BACKGROUND OF THE INVENTION

1. Field of the Invention

The present invention relates to the field of design and construction of shoes. More particularly, the present invention relates to the field of shoe designs which includes at least one compartment for concealing items 2. Description of the Prior Art Many types of shoes are known in the prior art. However, while shoes have been developed for unique stylized designs and for comfort and wearablity including shoes for special purposes such as walking, hiking and fashion, shoes have not been used as a device to carry valuable items in a concealed way.

Many women fear carrying valuable items such as credit cards and cash in their purse where it can be snatched. There is a significant need for a unique wearing item which enables valuables such as credit cards, cash and keys to be retained in a safe and concealed manner.

SUMMARY OF THE INVENTION

The present invention is a shoe having the unique feature of a concealed compartment within the shoe to enable valuables such as cash, keys, coins, jewelry and credit cards to be concealed in a safe and secure manner so that they are concealed while at the same time not interfering with the wearability of the shoe.

It has been discovered, according to the present invention, that if a portion of the shoe such as the inner sole is divided into two longitudinal sections, then a compartment for retaining items can be formed into one of the sections and concealed by the overlay of the mating second inner sole section.

It has further been discovered, according to the present invention, that if the first and second inner sole sections are at least partially removably affixed to each other by attachment means such as mating hook and loop fasteners, then the compartment remains concealed and obscured from view so that the items retained therein are kept in a safe and secure manner and still can be readily accessed to insert and remove items from the compartment.

It has further been discovered, according to the present invention, that if the upper section of the inner sole is covered by an insole which may also contain padding between the insole and the upper section of the inner sole or have an insole which is padded, then the wearer can comfortably wear the shoe without any discomfort received from the items retained in the compartment.

It has additionally been discovered, according to the present invention, that if the compartment extends for a portion of the length of the shoe, then flat items such as bills and cash, spa keys, home keys, gym keys, coins, lucky charms, jewelry, business cards, phone cards, credit cards, identification cards such as driver's licenses and ATM cards can be safely concealed and stored within the pocket.

It has also been discovered that in an alternative embodiment, instead of having the inner sole divided into two longitudinal sections, a separate compartment layer may be affixed between the interior surface of the outer sole of the shoe and the one-piece inner sole, with the separate compartment layer having the compartment for retaining items. The separate compartment layer is itself affixed to the interior surface of the outer sole of the shoe and has the means for removably attaching a portion of the separate compartment layer to the lower surface of the one-piece inner sole.

It is therefore an object of the present invention to provide a concealed pocket for safely retaining flat items such as keys, bills, coins, jewelry and various cards such as business cards, driver's licenses, credit cards etc. in a safe and secure manner so that they are hidden within the shoe while at the same time enabling the wearer to comfortably wear the shoe in a normal manner.

It is another object of the present invention to provide means for removably opening a section of the shoe such as mating sections of an inner sole or the location between a separate compartment layer and the one-piece inner sole so that the items contained within the compartment concealed within a portion of the inner sole or compartment layer can be readily accessible by simply removing the shoe and lifting up one portion of the shoe from the other.

It is an additional object of the present invention to have the mating sections of the shoe which conceal the pocket having the items therein removably attached to each other by means such as hook and loop fasteners, snap fasteners, etc.

It is another object of the present invention to form a pocket into any type of shoe whether it be a fashion shoe, wearing shoe, hiking shoe, or any other shoe wherein a portion of the inner sole or separate compartment layer can be easily accessed to reach a concealed pocket within the inner sole or separate compartment layer to place the items within the concealed compartment and thereafter remove the items when needed.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
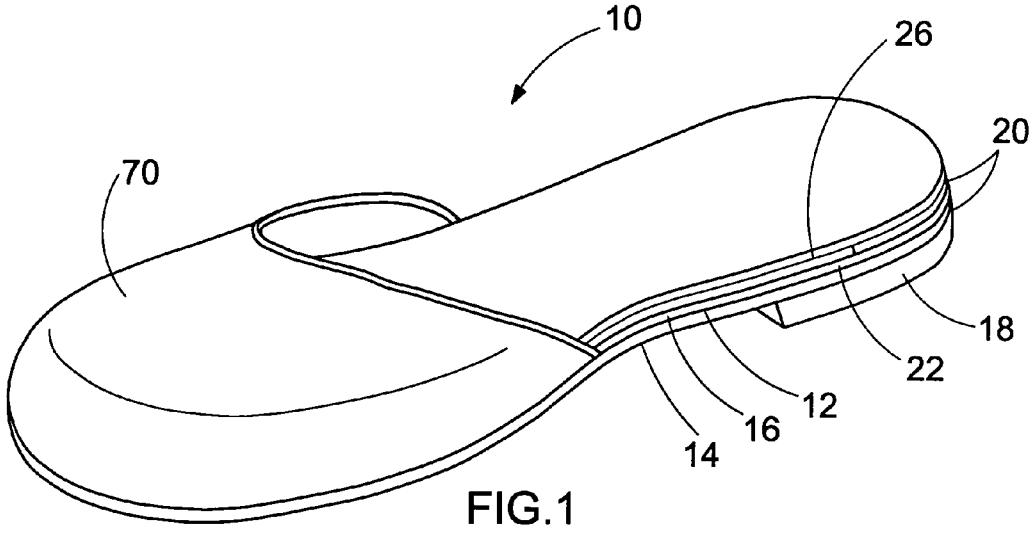
FIG. 1 is a perspective view of the present invention shoe in the wearing condition where the concealed compartment retaining items is concealed within the shoe and obscured from view.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 5, there is shown at 10 one embodiment of the present invention shoe. The present invention shoe 10 comprises an outer sole of the shoe 12. The outer sole includes an exterior surface 14 of the outer sole and an interior surface 16 of the outer sole of the shoe 10. The heel 18 of the shoe is attached to the rear portion of the exterior surface 14 of the outer sole of the shoe 12.

Figure 2:
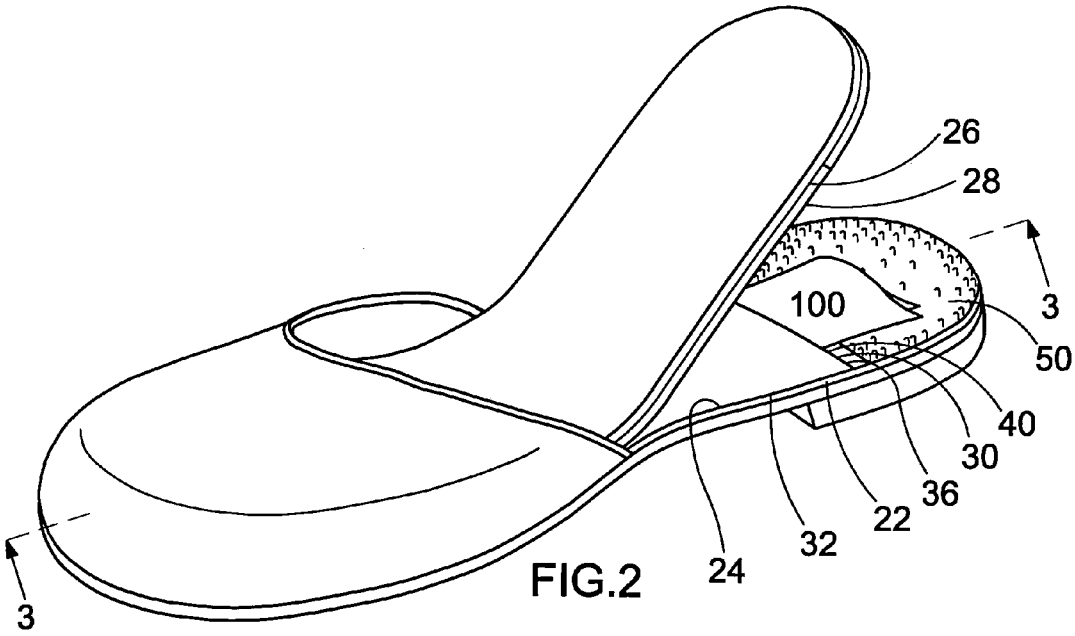
FIG. 2 is a side elevational view of the present invention shoe with a portion of the second section of inner sole and its affixed insole extended from the lower section of inner sole to expose the concealed compartment within the lower section of the inner sole and expose its contents.
Figure 3:
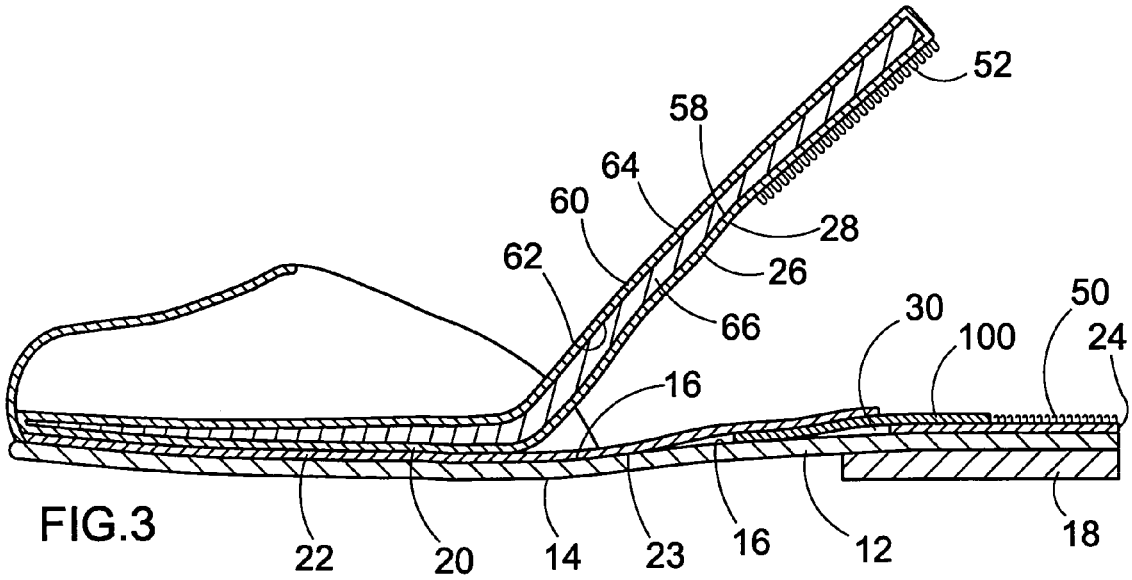
FIG. 3 is a cross-sectional view taken along Line 3—3 of FIG. 2.
Figure 4:
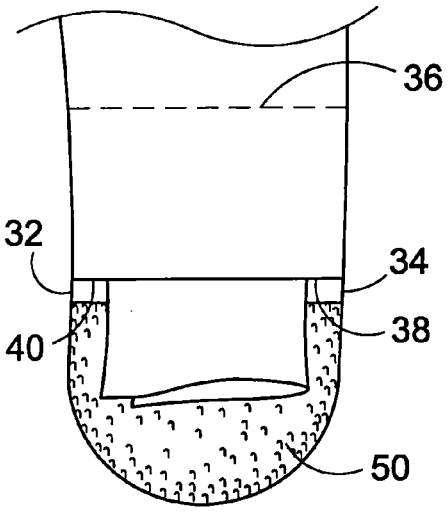
FIG. 4 is a top plan view of a portion of the lower section of inner sole.
Figure 5:
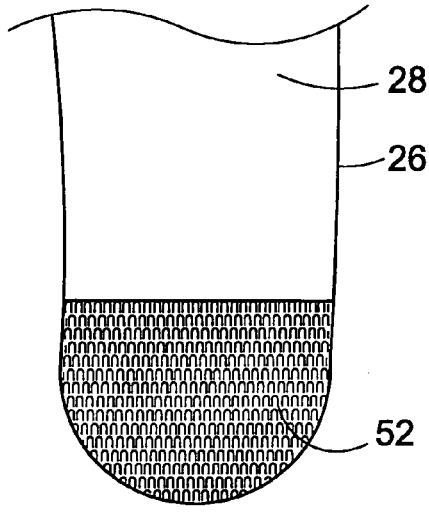
FIG. 5 is a bottom plan view of a portion of the upper section of inner sole.

Affixed to the outer sole of the shoe is the inner sole 20 of the shoe 10. A unique feature of the present invention is to divide the inner sole 20 into two separate sections, a first lower section 22 and a second upper section 26. The inner sole 20 extends for the entire length of the shoe as illustrated in FIGS. 2 and 3. The first lower section 22 of the inner sole 20 further comprises a concealed compartment 30 which is located adjacent the heel area as shown in FIGS. 2 and 3 formed into the lower section 22 of the inner sole 20 of the shoe 10. The concealed compartment 30 comprises a first edge 32, a second edge 34,a front edge 36 and a rear edge 38. As illustrated in the figures, the first and second lengthwise edges 32 and 34 and the front edge 36 are stitched together to form a closed portion of the compartment. The rear edge 38 contains an opening 40 located adjacent the heel 18 by which access can be gained to the concealed compartment 30.

The second upper section of the inner sole 26 contains a lower surface 28 which abuts and mates with the upper surface 24 of the first lower section 22 of the inner sole 20. The lower surface 28 of the second section 26 of the two portion inner sole 20 forms a completely concealed package so that when the lower surface 28 of the second section 26 of the inner sole 20 is formed against the upper surface 24 of the first lower section 22 of the inner sole 20, the compartment 30 is completely concealed.

Attached to the rear portion of the upper surface 24 of first lower section 22 of inner sole 20 is a first fastener means 50. Attached to the rear portion of the lower surface 28 of the second upper section 26 of inner sole 20 is a second mating fastener means 52. By way of example, the fastener means can be hook and loop fasteners 50 and 52 respectively as illustrated in the figures. It will be appreciated that other fastener means which, by way of example, can be mating snap fasteners, can also be utilized and are within the spirit and scope of the present invention.

As illustrated in the figures, the lower surface 23 of the first lower section of the inner sole is affixed to the interior surface 16 of the outer sole of the shoe.

Attached above the upper surface 58 of the second upper section 26 of the inner sole 20 is the insole 60. The insole 60 has a lower surface 62 which is aligned with and abuts and is attached to the upper surface 58 of the upper second section 26 of the inner sole 20. The upper surface 64 of the insole 60 is exposed and the foot rests on top of the upper surface 64 of the insole 60. Also as illustrated in the cross-sectional view of FIG. 3, there is an optional padding 66 which may be contained between the insole 60 and the inner sole 20. Alternatively, the insole 60 itself can be made of padded material. The purpose of the padding or the padded insole 60 is to provide sufficient cushioning so that the wearer will not have any discomfort by the objects contained within the compartment 30 while wearing the shoe.

The body of the shoe 70 is attached to the front portion of the shoe as illustrated in the figures and can be affixed between the interior surface 16 of the outer sole 12 of the shoe 10 and the lower surface 23 of first lower section 22 of inner sole 20.

Items 100 such as hotel room keys, spa keys, home keys, gym keys, lucky charms, cash and bills, coins, jewelry, and cards such as driver's licenses, identification cards, ATM cards, credit cards, phone cards and business cards, can be retained within the concealed compartment 30. As illustrated in FIG. 1, when the mating fasteners 50 and 52 are brought together, the compartment 30 is completely concealed within the shoe and therefore, is obscured from view. Therefore, the wearer can safely wear the shoe without fear that the valuable items 100 contained within the compartment 30 may be lost or exposed. When access is desired to be gained to the compartment, the wearer simply removes the shoe from the wearer's foot, and raises the second upper section 22 of the inner sole 20 from the first lower section 22 of the inner sole 20 so that the concealed compartment 30 is exposed and the items retained therein can be accessed by means of opening 40.

Referring to FIGS. 6 through 10, there is shown at 110 an alternative embodiment of the present invention shoe. The alternative embodiment of the present invention shoe 110 comprises an outer sole of the shoe 112. The outer sole includes an exterior surface 114 of the outer sole and an interior surface 116 of the outer sole of the shoe 110. The heel 118 of the shoe is attached to the rear portion of the exterior surface 114 of the outer sole of the shoe 112.

Figure 7:
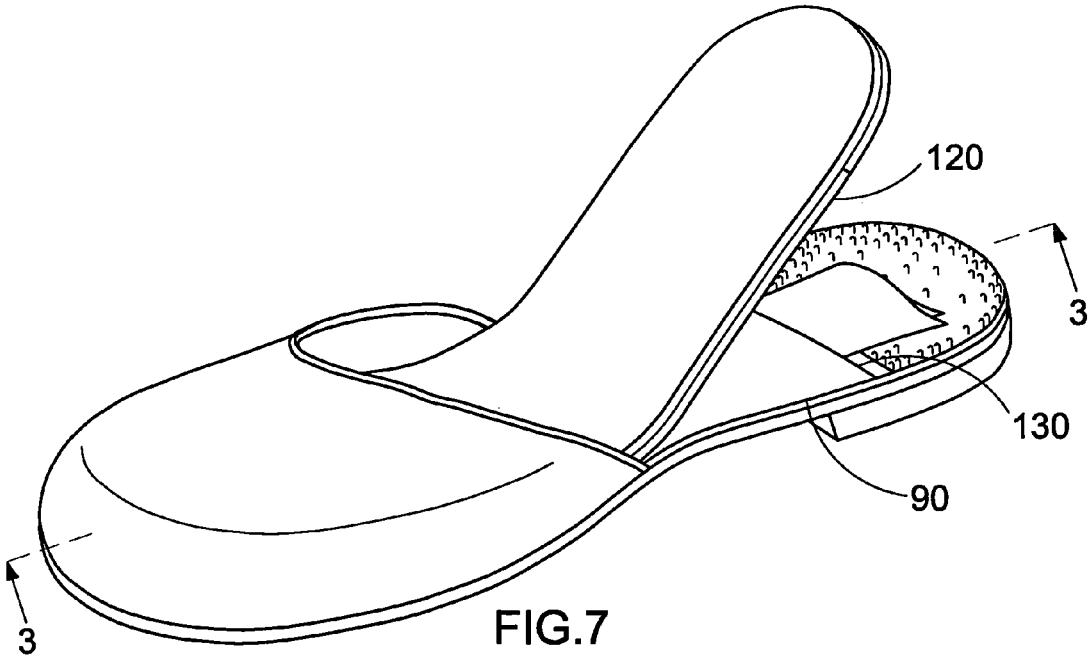
FIG. 7 is a side elevational view of the alternative embodiment of the present invention shoe illustrated in FIG. 6, with a portion of the one-piece inner sole and its affixed insole extended from the separate compartment layer to expose the concealed compartment within the separate compartment layer and expose its contents.
Figure 8:
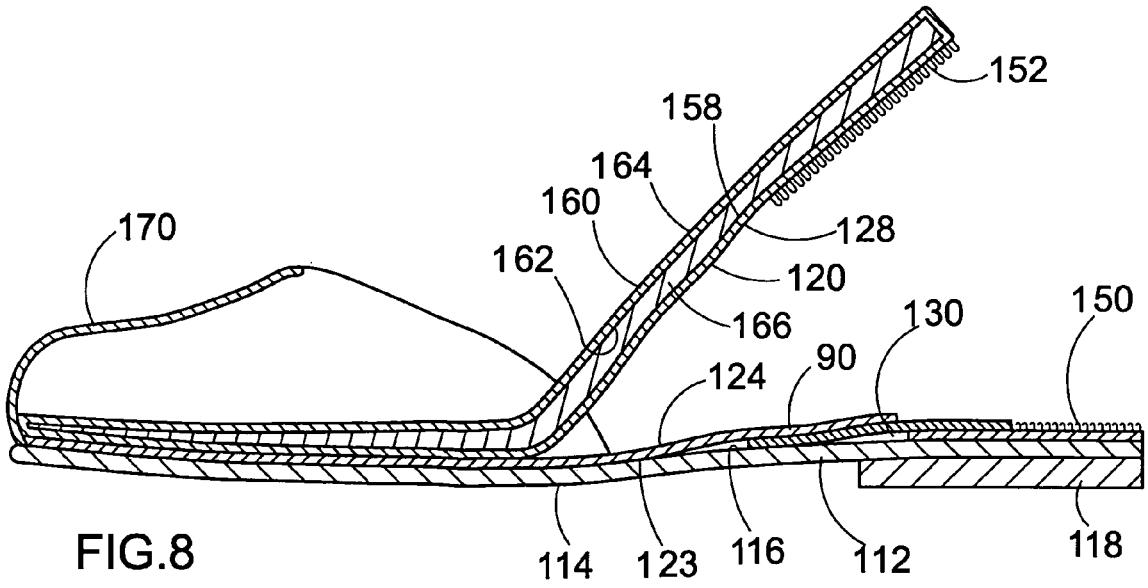
FIG. 8 is a cross-sectional view taken along Line 8—8 of FIG. 7.
Figure 9:
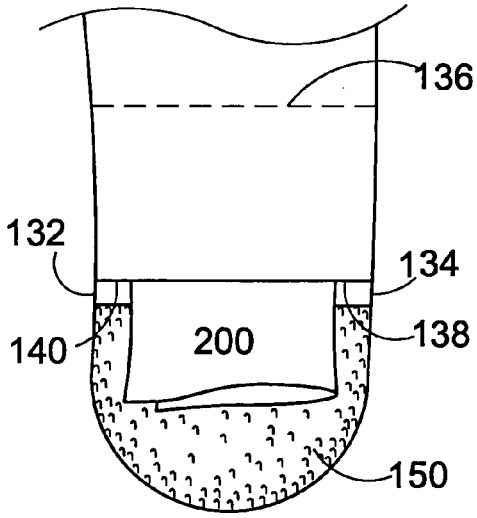
FIG. 9 is a top plan view of a portion of the separate compartment layer.
Figure 10:
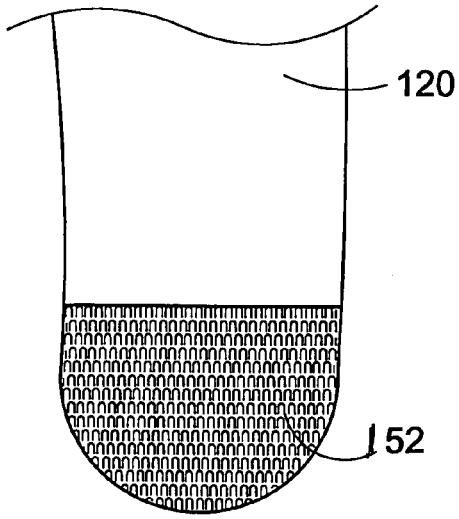
FIG. 10 is a bottom plan view of a portion of the one-piece inner sole.

In the alternative embodiment of the present invention, affixed to the interior surface 116 of the outer sole of the shoe is a separate compartment layer 90 which extends for the entire length of the shoe as illustrated in FIGS. 7 and 8. The separate compartment layer further comprises a concealed compartment 130 which is located adjacent the heel area as illustrated in FIGS. 7 and 8 formed into the separate compartment section 90 of the shoe 110. The concealed compartment 130 comprises a first edge 132, a second edge 134, a front edge 136, and a rear edge 138. As illustrated in the figures, the first and second lengthwise edges 132 and 134 and the front edge 136 are stitched together to form a closed portion of the compartment. The rear edge 138 contains an opening 140 located adjacent the heel area by which access can be gained to the concealed compartment 130.

Set above the separate compartment layer 90 is the inner sole 120 which contains a lower surface 128 which abuts and mates with the upper surface 124 of the separate compartment section 90. The lower surface 128 of the inner sole 120 when it abuts against the upper surface 124 of the separate compartment section 90 forms a completely concealed package so that the compartment 130 is completely concealed.

Attached to the rear portion of the upper surface 124 of the separate compartment section 90 is a first fastener means 150. Attached to the rear portion of the lower surface 128 of the inner sole 120 is a second mating fastener means 152. By way of example, the fastener means can be hook and loop fasteners 150 and 152 respectively as illustrated in the figures. It will be appreciated that other fastener means which, by way of example, can be mating snap fasteners, can also be utilized and are within the spirit and scope of the present invention.

As illustrated in the figures, the lower surface 123 of the separate compartment section 90 is affixed to the interior surface 116 of the outer sole of the shoe 110.

Attached above the upper surface 158 of the inner sole 120 is the insole 160. The insole 160 has a lower surface 162 which is aligned with and abuts and is attached to the upper surface 158 of the inner sole 120. The upper surface 164 of the insole 160 is exposed and the foot rests on top of the upper surface 164 of the insole 160. Also as illustrated in the cross-sectional view of FIG. 3, there is an optional padding 166 which may be contained between the insole 160 and the inner sole 120. Alternatively, the insole 160 itself can be made of padded material. The purpose of the padding or the padded insole 160 is to provide sufficient cushioning so that the wearer will not have any discomfort by the objects contained within the compartment 130 while wearing the shoe.

The body of the shoe 170 is attached to the front portion of the shoe as illustrated in FIGS. 6 through 10 and can be affixed between the interior surface 116 of the outer sole 112 of the shoe 110 and the lower surface 123 of separate compartment section 90 or alternatively, between the interior surface 116 of the outer sole 112 of the shoe 110 and the lower surface 128 of the inner sole 20.

Figure 6:
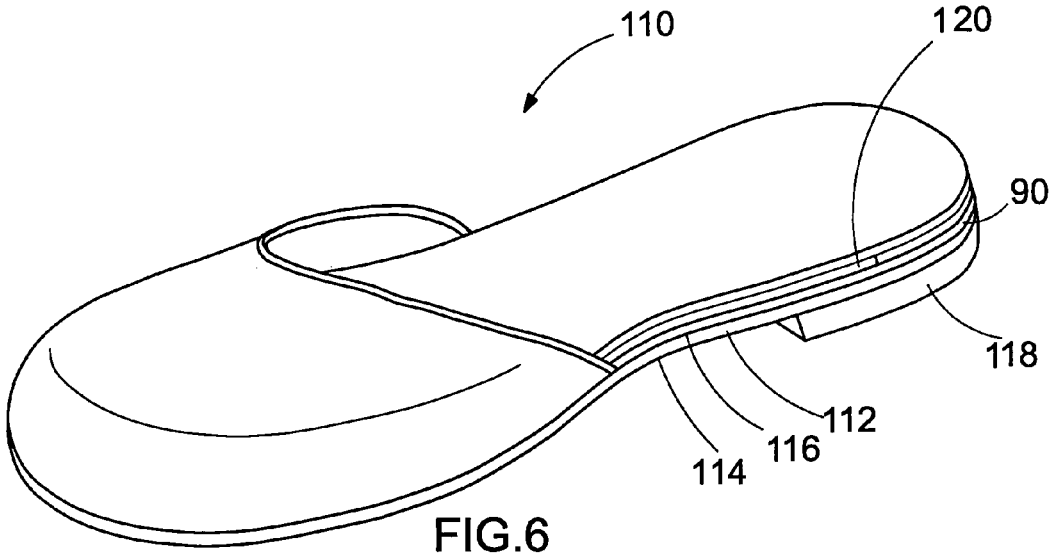
FIG. 6 is a perspective view of an alternative embodiment of the present invention shoe in the wearing condition where the concealed compartment retaining items is in a separate compartment layer concealed within the shoe and obscured from view.

Items 200 such as hotel room keys, spa keys, home keys, gym keys, lucky charms, cash and bills, coins, jewelry, and cards such as driver's licenses, identification cards, ATM cards, credit cards, phone cards and business cards, can be retained within the concealed compartment 130. As illustrated in FIG. 6, when the mating fasteners 150 and 152 are brought together, the compartment 130 is completely concealed within the shoe and therefore, is obscured from view. Therefore, the wearer can safely wear the shoe without fear that the valuable items 200 contained within the compartment 130 may be lost or exposed. When access is desired to be gained to the compartment, the wearer simply removes the shoe from the wearer's foot, and raises the second inner sole 20 from the separate compartment section 90 so that the concealed compartment 130 is exposed and the items retained therein can be accessed by means of opening 140.

The alternative embodiment of the shoe can also be made of any type of desired material and any style. The separate compartment layer 90 can be made of fabric material. It can be a walking shoe, running shoe, hiking shoe, fashion shoe etc., and can be a flat shoe as illustrated in the figures or can be a shoe with a higher heel. The concept of the present invention enables the wearer to safely wear the shoe while retaining valuable items within the concealed compartment.

Defined in detail, the present invention is a shoe comprising: (a) an outer sole having an exterior surface, an interior surface, a front portion and a rear portion; (b) a heel attached to the exterior surface of the rear portion of the outer sole; (c) an inner sole having an aligned first lower section and second upper section, the first lower section having a lower surface aligned with the upper surface of the outer sole, the lower section of the inner sole affixed to the outer sole; (d) the first lower section of the inner sole further comprising an upper surface into which is formed adjacent the heel a compartment to retain objects, the compartment having a first lengthwise edge, a second lengthwise edge, a front edge all of which are affixed to the upper surface to form a closed portion of the compartment and a rear edge containing an opening adjacent the location of the heel through which access can be gained to the compartment; (e) the second upper section of the inner sole matching the shape of the first lower section, the second upper section having a lower surface which abuts and mates with the upper surface of the first lower section, the second upper section being partially attached to the first lower section along their respective first halves, the two sections being aligned but separated along their respective rear halves; (f) a first fastener means attached to the rear portion of the upper surface of the first lower section and a second mating fastener means attached to the rear lower surface of the second upper section, so that when the two fastener means are brought together, the two sections of the inner sole are aligned and the compartment is concealed and when the fastener means are separated and the rear half of the second upper section is moved away from the rear half of the first lower section, the compartment is exposed; (g) an insole aligned with and affixed to an upper surface of the second section of the inner sole; and (h) a body attached to the front portion of the shoe; (i) whereby money, credit cards and other items may be safely retained within the compartment.

Defined broadly, the present invention is a shoe including a heel, comprising: (a) an inner sole sandwiched between an outer sole and an insole; (b) the inner sole having two aligned sections which are a lower section and an upper section, the lower section affixed to the outer sole and the upper section affixed to the insole; (c) the lower section of the inner sole further comprising an upper surface which faces and is aligned with a lower surface of the second section, a compartment adjacent the heel for retaining objects formed into the lower section of the inner sole, the compartment having an opening adjacent the location of the heel aligned with the upper surface of the lower section of the inner sole so that objects can be inserted into and removed from the compartment when the upper surface at the location of the opening is exposed; (d) the upper section of the inner sole being affixed to a portion of the lower section of the inner sole and removably aligned with another portion of the lower section of the inner sole at the location of the opening to the compartment; and (e) mating fastener means attached at opposing surfaces of the lower section and the upper section such that when the fastener means are closed, the compartment and opening are concealed within the inner sole and when the fastener means are opened and a portion of the upper section is moved away from the lower section, the opening to the compartment is exposed.

Defined more broadly, the present invention is a shoe including a heel, comprising: (a) an inner sole sandwiched between an outer sole and an insole; and (b) the inner sole being formed in two opposing sections wherein a portion of one section is removable from an opposing portion of the other section, the inner sole having a concealed compartment for retaining objects formed into the inner sole, the compartment having an opening adjacent the location of the heel which is exposed when one portion of the inner sole is moved away from the opposing portion of the inner sole.

In an alternative embodiment, the present invention defined in detail is a shoe including a heel, comprising: (a) an outer sole having an exterior surface, an interior surface, a front portion and a rear portion; (b) a heel attached to the exterior surface at the rear portion of the outer sole; (c) a compartment layer which extends for at least a portion of the length of the shoe, a concealed compartment located adjacent the heel formed into the compartment layer, the compartment layer having an upper surface through which an access opening adjacent the location of the heel is formed to gain access to the concealed compartment, the compartment layer having a lower surface adjacent the interior surface of the outer sole, the compartment layer affixed to the outer sole; (d) an inner sole having a lower surface aligned with an positioned above the compartment layer, the inner sole affixed to a portion of the compartment layer and removably aligned above the compartment layer at the location of the opening to the compartment; (e) a first fastener means attached to a rear portion of the upper surface of the compartment layer and a second mating fastener means attached to a rear portion of the lower surface of the inner sole, so that when the two fastener means are brought together, the compartment layer and the inner sole are aligned and attached and the compartment is concealed and when the fastener means are separated and a portion of the inner sole is moved away from a portion of the compartment layer, the opening to the compartment is exposed; (f) an insole aligned with and affixed to an upper surface of the inner sole; and (g) a body attached to the front portion of the shoe; (h) whereby money, credit cards and other items may be safely retained within the compartment.

Defined more broadly, the alternative embodiment of the present invention is a shoe including a heel, comprising: (a) an outer sole, a separate compartment layer aligned with and positioned above the outer sole, an inner sole aligned with and positioned above the separate compartment layer, and an insole aligned with and positioned above the inner sole; (b) the separate compartment layer affixed to the outer sole, the separate compartment layer having a compartment located adjacent the heel for retaining objects formed into the separate compartment layer, the compartment having an opening adjacent the location of the heel aligned with an upper surface of the separate compartment layer so that objects can be inserted into and removed from the compartment when the upper surface at the location of the opening is exposed; and (c) the inner sole having a lower surface aligned with and positioned above the separate compartment layer, the inner sole affixed to a portion of the separate compartment layer and removably aligned above the separate compartment layer at the location of the opening to the compartment.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A shoe comprising:

a. an outer sole having an exterior surface, an interior surface, a front portion and a rear portion;

b. a heel attached to the exterior surface of the rear portion of the outer sole;

c. an inner sole having an aligned first lower section and second upper section, the first lower section having a lower surface aligned with the upper surface of the outer sole, the lower section of the inner sole affixed to the outer sole;

d. the first lower section of the inner sole further comprising an upper surface into which is formed adjacent the heel a compartment to retain objects, the compartment having a first lengthwise edge, a second lengthwise edge, a front edge all of which are affixed to the upper surface to form a closed portion of the compartment and a rear edge containing an opening adjacent the location of the heel through which access can be gained to the compartment;

e. the second upper section of the inner sole matching the shape of the first lower section, the second upper section having a lower surface which abuts and mates with the upper surface of the first lower section, the second upper section being partially attached to the first lower section along their respective first halves, the two sections being aligned but separated along their respective rear halves;

f. a first fastener means attached to the rear portion of the upper surface of the first lower section and a second mating fastener means attached to the rear lower surface of the second upper section, so that when the two fastener means are brought together, the two sections of the inner sole are aligned and the compartment is concealed and when the fastener means are separated and the rear half of the second upper section is moved away from the rear half of the first lower section, the compartment is exposed;

g. an insole aligned with and affixed to an upper surface of the second section of the inner sole; and h. a body attached to the front portion of the shoe;

i. whereby money, credit cards and other items may be safely retained within the compartment.

2. A shoe including a heel, comprising:

a. an inner sole sandwiched between an outer sole and an insole;

b. the inner sole having two aligned sections which are a lower section and an upper section, the lower section affixed to the outer sole and the upper section affixed to the insole;

c. the lower section of the inner sole further comprising an upper surface which faces and is aligned with a lower surface of the second section, a compartment adjacent the heel for retaining objects formed into the lower section of the inner sole, the compartment having an opening adjacent the location of the heel aligned with the upper surface of the lower section of the inner sole so that objects can be inserted into and removed from the compartment when the upper surface at the location of the opening is exposed;

d. the upper section of the inner sole being affixed to a portion of the lower section of the inner sole and removably aligned with another portion of the lower section of the inner sole at the location of the opening to the compartment; and e. mating fastener means attached at opposing surfaces of the lower section and the upper section such that when the fastener means are closed, the compartment and opening are concealed within the inner sole and when the fastener means are opened and a portion of the upper section is moved away from the lower section, the opening to the compartment is exposed.

3. A shoe including a heel, comprising:

a. an inner sole sandwiched between an outer sole and an insole; and b. the inner sole being formed in two opposing sections wherein a portion of one section is removable from an opposing portion of the other section, the inner sole having a concealed compartment adjacent the heel for retaining objects formed into the inner sole, the compartment having an opening adjacent the location of the heel which is exposed when one portion of the inner sole is moved away from the opposing portion of the inner sole c. mating fasteners means on opposing surfaces of the two sections of the inner sole to retain them together and which permits the sections to be separated to gain access to the compartment.

4. A shoe including a heel, comprising:

a. an outer sole having an exterior surface, an interior surface, a front portion and a rear portion;

b. a heel attached to the exterior surface at the rear portion of the outer sole;

c. a compartment layer which extends for at least a portion of the length of the shoe, a concealed compartment located adjacent the heel formed into the compartment layer, the compartment layer having an upper surface through which an access opening adjacent the location of the heel is formed to gain access to the concealed compartment, the compartment layer having a lower surface adjacent the interior surface of the outer sole, the compartment layer affixed to the outer sole;

d. an inner sole having a lower surface aligned with an positioned above the compartment layer, the inner sole affixed to a portion of the compartment layer and removably aligned above the compartment layer at the location of the opening to the compartment;

e. a first fastener means attached to a rear portion of the upper surface of the compartment layer and a second mating fastener means attached to a rear portion of the lower surface of the inner sole, so that when the two fastener means are brought together, the compartment layer and the inner sole are aligned and attached and the compartment is concealed and when the fastener means are separated and a portion of the inner sole is moved away from a portion of the compartment layer, the opening to the compartment is exposed;

f. an insole aligned with and affixed to an upper surface of the inner sole; and g. a body attached to the front portion of the shoe;

h. whereby money, credit cards and other items may be safely retained within the compartment.

5. A shoe including a heel, comprising:

a. an outer sole, a separate compartment layer aligned with and positioned above the outer sole, an inner sole aligned with and positioned above the separate compartment layer, and an insole aligned with and positioned above the inner sole;

b. the separate compartment layer affixed to the outer sole, the separate compartment layer having a compartment located adjacent the heel for retaining objects formed into the separate compartment layer, the compartment having an opening adjacent the location of the heel aligned with an upper surface of the separate compartment layer so that objects can be inserted into and removed from the compartment when the upper surface at the location of the opening is exposed; and c. the inner sole having a lower surface aligned with and positioned above the separate compartment layer, the inner sole affixed to a portion of the separate compartment layer and removably aligned above the separate compartment layer at the location of the opening to the compartment.

6. The shoe as defined in claim 5 further comprising a first fastener means attached to a portion of the upper surface of the separate compartment layer and a second mating fastener means attached to a portion of the lower surface of the inner sole, so that when the two fastener means are brought together, the separate compartment layer and the inner sole are aligned and attached and the compartment is concealed and when the fastener means are separated and a portion of the inner sole is moved away from a portion of the separate compartment layer, the opening to the compartment is exposed.

* * * * *